US006074055A

United States Patent [19]

Myung

[11] Patent Number: 6,074,055

[45] Date of Patent: Jun. 13, 2000

[54] PAPER TRANSPORTING SYSTEM AND METHOD OF AN INK-JET PRINTER FOR PREVENTING JAMMING AND FOLDING OF PAPER

[75] Inventor: Ho-Suck Myung, Kyonggi-do, Rep. of Korea

[73] Assignee: SamSung Electronics Co., Ltd., Kyungki-do, Rep. of Korea

[21] Appl. No.: 08/929,473

[22] Filed: Sep. 15, 1997

[30] Foreign Application Priority Data

Sep. 17, 1996 [KR] Rep. of Korea ..... 96-40395

[51] Int. Cl.[7] ..... B41J 2/01

[52] U.S. Cl. ..... 347/104

[58] Field of Search ..... 347/16, 104, 37, 347/4, 8; 400/708, 55, 59; 271/272, 275; 318/665, 600, 605

[56] References Cited

U.S. PATENT DOCUMENTS

| | | | |
|---|---|---|---|
| 4,293,863 | 10/1981 | Davis et al. | 347/104 |
| 4,500,217 | 2/1985 | Swindler | 347/104 |
| 4,537,521 | 8/1985 | Rekewitz et al. | 347/104 |
| 4,636,100 | 1/1987 | Fujisawa | 347/104 |
| 4,688,958 | 8/1987 | Tajima | 347/104 |
| 4,839,674 | 6/1989 | Hanagata et al. | 347/104 |
| 5,090,686 | 2/1992 | Kemp et al. | 347/104 |
| 5,321,464 | 6/1994 | Jessen et al. | 347/104 |
| 5,450,158 | 9/1995 | Jessen et al. | 347/104 |
| 5,544,580 | 8/1996 | Takahashi | 347/104 |
| 5,651,623 | 7/1997 | Stodder et al. | 347/104 |
| 5,920,743 | 7/1999 | Yamada et al. | 347/104 |

*Primary Examiner*—N. Le
*Assistant Examiner*—Thien Tran
*Attorney, Agent, or Firm*—Robert E. Bushnell, Esq.

[57] ABSTRACT

In a transporting system and method for an ink-jet printer, a paper is transported to an ejecting area without being jammed or folded by moving a print head back and forth to level-guide the transported paper with respect to the lower surface of the print head when the paper is at a designated position, while continuously transporting the paper toward the ejecting area. The system and method provide for a paper sensor which generates a sensing signal when the paper enters the paper feeding area, a position value designator which stores first and second designated position values, and an arithmetic controller which counts the number of paper feed driving steps, compares the count value to the designated position values, and determines based on the latter comparison when the paper is at a point between the feed area and the eject area at which it needs to be supported by movement of the print head back and forth.

16 Claims, 5 Drawing Sheets

PAPER TRANSPORTING SYSTEM AND METHOD OF AN INK-JET PRINTER FOR PREVENTING JAMMING AND FOLDING OF PAPER

CLAIM OF PRIORITY

This application makes reference to, incorporates the same herein, and claims all benefits accruing under 35 U.S.C. §119 from an application for PAPER TRANSPORTING SYSTEM AND METHOD OF AN INK-JET PRINTER FOR PREVENTING A PAPER FROM BEING JAMMED AND FOLDED earlier filed in the Korean Industrial Property Office on the $17^{th}$ of September 1996 and there duly assigned Ser. No. 40395/1996.

BACKGROUND OF THE INVENTION

1. Technical Field

The present invention relates to a paper transporting system and method for an ink-jet printer which performs printing by moving a print head back and forth. More particularly, the invention relates to a system and method for transporting paper near a paper ejecting area, while simultaneously moving the print head back and forth to level-guide the transported paper so that the paper may eject without being jammed or folded.

2. Related Art

In general, ink-jet printers perform printing by receiving control signals from a controller. Based on the control signal, a print head composed of a plurality of minuscule nozzles moves back and forth so as to spread ink through the nozzles on a paper to complete a print job.

When a conventional ink-jet printer receives a print command, the controller sends a control signal to a paper feeder, causing the latter to feed paper continuously while a printing unit performs a print job. When the printing is completed, a paper ejector ejects the printed paper.

The following are representative of the prior art relative to conventional ink-jet printers: U.S. Pat. No. 5,651,623 to Stodder et al., entitled Multiple-Function Printer With Common Feeder/Output Path Mechanisms And Method Of Operation, U.S. Pat. No. 5,544,580 to Takahashi, entitled Mimeographic Printing Machine Having Sheet Jamming Detector, U.S. Pat. No. 5,450,158 to Jessen et al., entitled Optical Sensor For A Jam-Free Continuous-Forms Printer, U.S. Pat. No. 5,321,464 to Jessen et al., entitled Jam-Free Continuous-Forms Printer, U.S. Pat. No. 5,090,686, to Kemp et al., entitled Paper Guide Wheel, U.S. Pat. No. 4,688,958 to Tajima, entitled Paper Feeding Mechanism For Printer, U.S. Pat. No. 4,636,100 to Fujisawa, entitled Paper Feed Mechanism For Recording Apparatus, U.S. Pat. No. 4,500,217 to Swindler, entitled Electronic Printer Mechanism With Movable Printhead Assembly, and U.S. Pat. No. 4,293,863 to Davis et al., entitled Ink-Jet Printer With Laterally Movable Print Head.

However, in such conventional ink-jet printers, there is a long space or gap between a feed roller and a start-wheel thereof, and in that gap there is no means to support the paper. Moreover, when a user mishandles the paper package, or when sheets have been taken out of the package and/or exposed for a long time, the sheets often become folded or rolled. When folding or rolling of the paper is severe, the paper may become jammed inside the printer, or may become folded in the printer, usually at the corner of the paper. Furthermore, very thin papers are also susceptible to jamming, and this causes problems for users if these thin papers are severely folded or rolled. Moreover, even if such folded paper is ejected through an ejector of the printer, usually, the corner of the paper is unsuitably folded.

SUMMARY OF THE INVENTION

The object of the present invention is to overcome the problems of a conventional ink-jet printer as mentioned above by providing a system and method which transports a paper to the ejecting area without being jammed or folded.

In order to achieve the above object, according to the present invention, when the paper reaches a designated position while being transported, a print head moves back and forth to level-guide this transporting paper with the surface of the print head so that the paper may eject without being jammed or folded.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The preferred embodiment hereinafter will be described in more specific detail by referring to the accompanying drawings.

Figure 1:
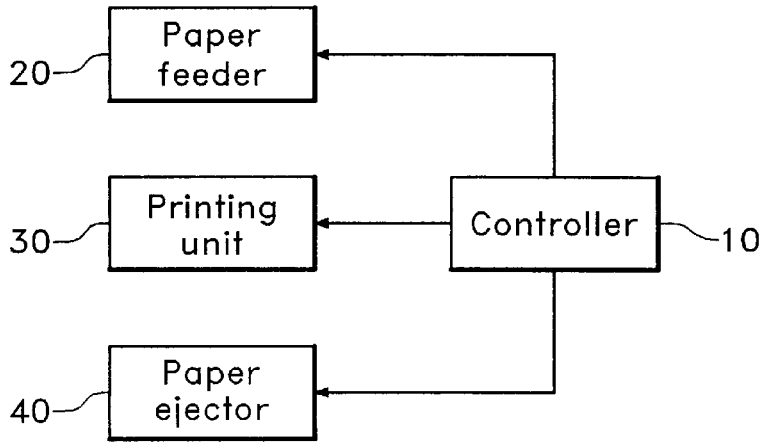
Fig. 1 PRIOR ART
FIG. 1 is a block diagram showing an abstract structure of a conventional ink-jet printer.

FIG. 1 illustrates a conventional ink-jet printer including: a paper feeder 20 for feeding paper inside the printer; a printing unit 30 for performing a print job on the paper by means of the paper feeder 20; a paper ejector 40 for ejecting the paper; and a main controller 10 for generating a control signal to each of the latter devices.

Figure 2:
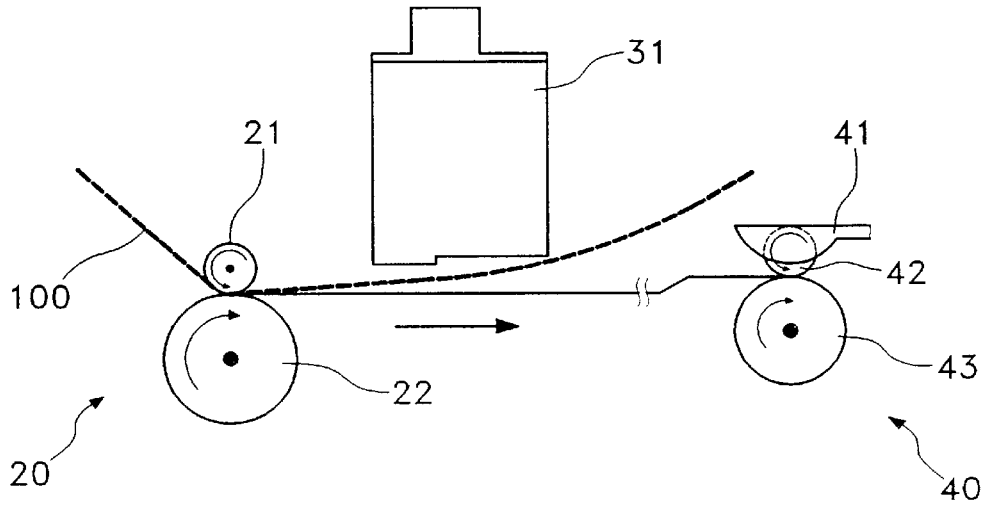
Fig. 2 PRIOR ART
FIG. 2 is schematic view showing the conventional ink-jet printer transporting a paper.

FIG. 2 illustrates the paper feeder 20 located near a paper inserting area having: a line feed (LF) motor (not shown) which is driven according to a control signal generated from the main controller 10; a feed roller 22 which rotates due to the driving of the LF motor; and a friction roller 21 which rotates adjacent to the feed roller 22. Paper 100 is transported to the inside of the printer through the feed roller 22 and the friction roller 21. A stepping motor, which has a predetermined detent torque so as to rotate one step at a time based on the control signal generated by the controller 10, is used as the LF motor.

The feed roller 22 receives a rotating force when the LF motor starts to drive so that the friction roller 21 rotates accordingly. Through these rollers 21 and 22, the paper 100 is transported to the inside of the printer.

When the paper 100 is transported to the inside of the printer in such fashion, printing begins by means of a print head 31 which is a part of the print unit 30.

Finally, the paper ejector 40 located near an ejecting area includes: an eject roller 43 which ejects the printed paper 100; a star-wheel 42 which is adjacent to the eject roller 43 so that they rotate together; and a guide star-wheel 41 on which the pivot of the star-wheel 42 is fixed. The printed paper 100 is guided toward the star-wheel 42 by means of the guide star-wheel 41. The star-wheel 42 supports the printed paper 100, while the eject roller 43 transports the paper 100 to the ejecting area.

When the conventional ink-jet printer receives a print command, the controller 10 sends a control signal to the paper feeder 20 to feed the paper 100 continuously while the printing unit 30 performs the print job. The paper ejector 40 ejects the printed paper 100 when the printing is completed.

However, such a conventional ink-jet printer has a long gap between the feed roller 22 and the star-wheel 42, in which gap there is no means to support the paper 100. Moreover, when a user mishandles a paper package, or when sheets have been exposed or out of the package and/or a long time, the sheets may become folded or rolled. The degree of rolling depends on the manufacture of the paper. When the paper is folded or rolled severely, the paper may become jammed inside the printer or folded, usually, at the corner of the paper.

In terms of feeding thick paper, such as glossy paper or over-head projector film (OHP film), which is folded or rolled, jamming frequently occurs. As illustrated by the dotted line in Fig. 2, such jamming usually occurs when the printed paper 100 rolls upward such that the printed paper 100 cannot be transported through the star-wheel 42 and the eject roller 43. Meanwhile, the feed roller 22 continuously rotates to cause the printed paper 100 to become jammed inside the printer. Even very thin paper is also susceptible to such jamming so as cause havoc to users if the very thin paper is severely folded or rolled enough.

Moreover, even if such folded paper is ejected through the eject roller 43, usually, the corner of the paper is unsuitably folded.

Figure 3:
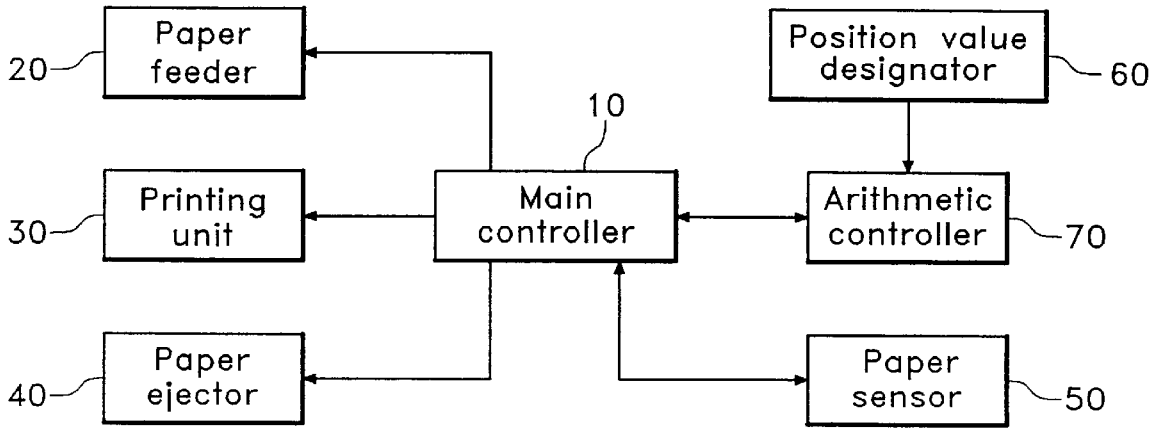
FIG. 3 is a block diagram showing a transporting structure according to the present invention.

FIG. 3 is a block diagram showing a transporting structure according to the present invention. According to the diagram, the transporting system of the present invention includes: a paper feeder 20 which drives an LF motor to feed paper 100 to an inside of the printer; a printing unit 30 which performs a printing job by operating a print head 31 when the paper 100 is fed; a paper ejector 40 which ejects the printed paper 100 when the printing is completed; a paper sensor 50 which senses a presence of paper; a position value designator 60 which stores a designated position value while the paper is being transported; an arithmetic controller 70 which counts the number of the LF motor driving steps, based on a sensing signal generated by the paper sensor 50, to calculate the difference between the counted value and the designated value; and a main controller 10 which commands the paper feeder 20 to transport the paper, and which also commands the print head 31 of the printing unit 30 to move back and forth to support the transported paper based on a calculated value provided by the arithmetic controller 70.

The paper sensor 50 is located at a designated position near the paper feeding area and paper feeder. When presence of paper is sensed, the paper sensor 50 generates a sensing signal and provides it to the controller 20.

The position value designator 60 stores a first designated position value and a second designated position value for determining a position at which the print head 31 needs to move back and forth to level-guide the transporting paper, and at which the print head 31 can stop moving positively.

The first designated position value is a count value of the LF motor driving steps indicating how many steps the LF motor needs to be driven from the point at which the paper is sensed by the paper sensor 50 to the point at which the print head 31 needs to be moving back and forth to level-guide the paper. The second designated position value indicates how many steps the LF motor needs ro be driven from the point at which the paper 100 is sensed by the paper sensor 50 until the paper 100 is transported to the ejecting area and paper ejector 40.

Figure 4:
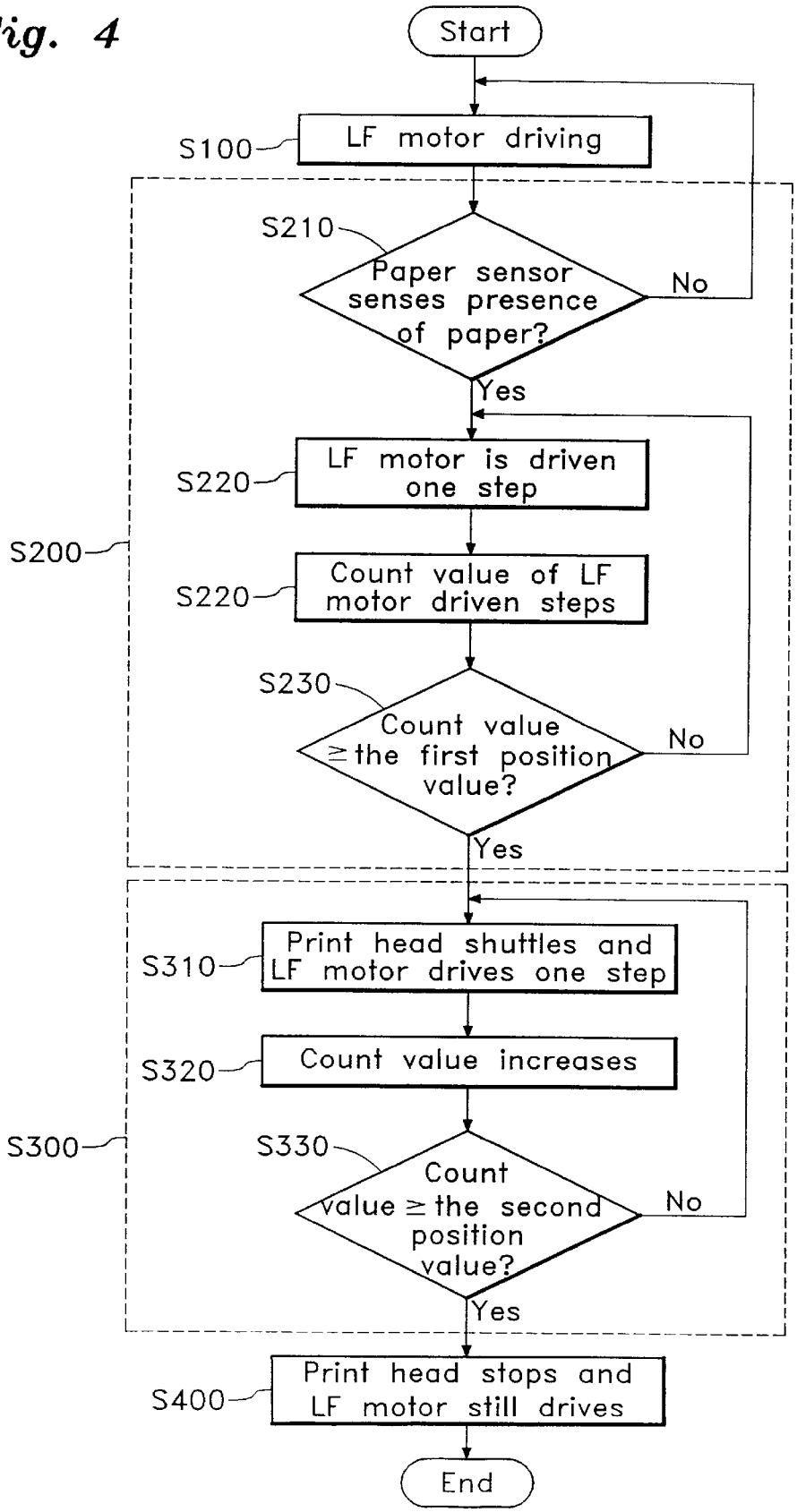
FIG. 4 is a flow chart showing the sequence of operations of a transporting method according to the present invention.

FIG. 4 is a flow the chart showing the sequence of operations of the above-mentioned transporting method.

According to the present invention, the transporting method includes: a paper loading step S100 for feeding paper 100 to the inside of the printer; a first transporting step S200 for transporting the paper 100 from the position at which the presence of the paper 100 is sensed by the paper sensor 50 to the first designated position; a paper guiding step S300 for transporting the paper 100 from the first designated position to the second designated position while the print head 31 moves back and forth to level-guide the paper 100; and a second transporting step S400 for stopping the print head 31 once the paper 100 reaches the second designated position while continuously transporting the paper 100.

In the first transporting step, when the presence of the paper 100 transported from the paper loading step is sensed by the paper sensor 50, the LF motor is driven one step at a time. The motor steps are counted and compared to the first designated position value determined by the designated position value designator 60. Such process is repeated until the count value at least equals the first designated position value (S210, S220, S230, and S240).

In the paper guiding step S300, when the count value of the first transporting step is equal to or greater than the first designated position value, the LF motor is continuously driven one step at a time while the print head 31 starts to move back and forth to level-guide the paper 100 with respect to the surface of the print head 31. Meanwhile, the count value is continuously compared to the second designated position value determined by the position value designator 60. Again, such process is repeated until the count value at least equals that of the second designated position (S310, S320, and S330).

In the second transporting step (S400), when the paper 100 reaches the second designated position, the print head 31 stops moving, and the LF motor is continuously driven to transport the paper 100 to the ejecting area.

Figure 5:
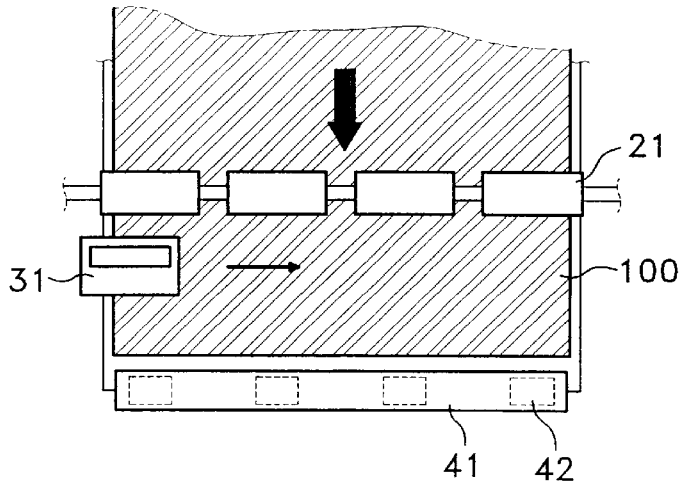
FIGS. 5*a*, 5*b*, 5*c* are sectional, schematic views showing the sequences of the print head moving back and forth according to the present invention.
Figure 5:
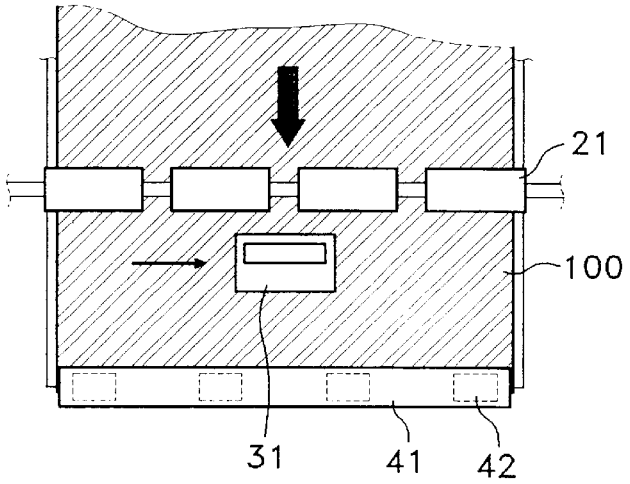
Figure 5:
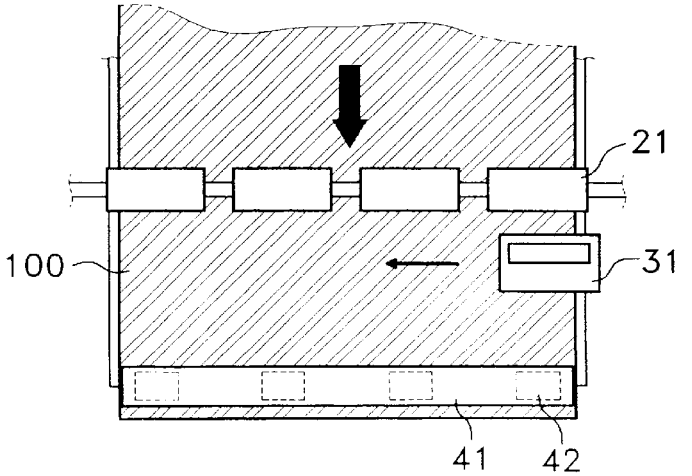
Figure 6:
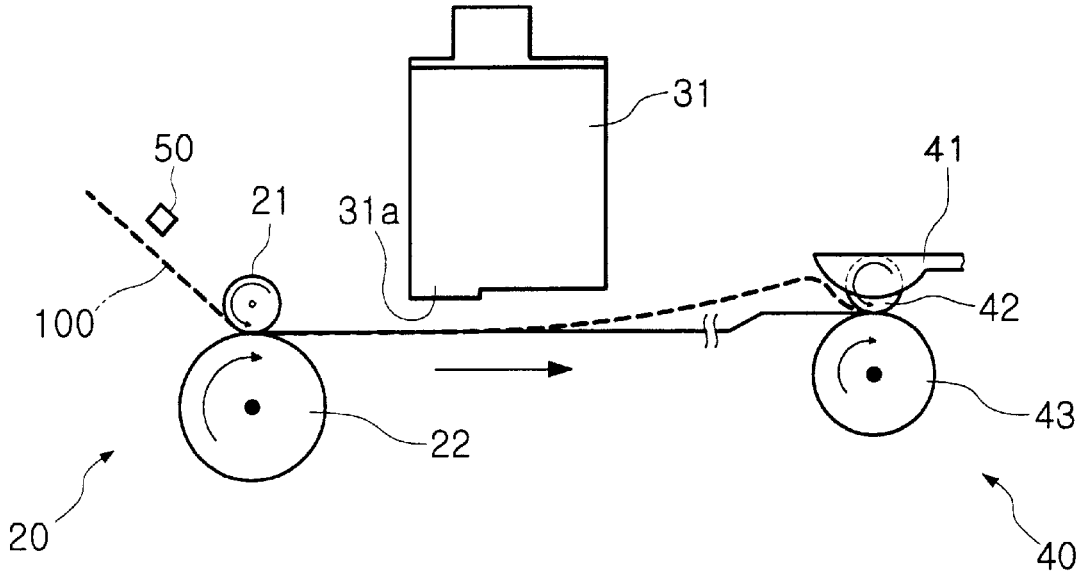
FIG. 6 is a schematic view showing a printer transporting the paper according to the present invention.

Figs. 5*a*, 5*b* and 5*c* show sequences of the print head 31 as it moves back and forth according to the present invention, while FIG. 6 shows the printer transporting the paper 100 according to the present invention. The following describes the operations of the printer in executing the transporting method, as mentioned above, in more detail by referring to FIGS. 3 to 6.

When power is turned on, and a print command is sent, the main controller 10 generates a control signal and sends it to the paper feeder 20. Based on that control signal, the LF motor of the paper feeder 20 starts to drive the feed roller 22, causing it to rotate so as to feed paper 100 to the inside of the printer (S100).

The paper 100 is transported by means of the feed roller 22 so as to be sensed by the paper sensor 50. Once the presence of the paper is sensed the paper sensor 50 generates a sensing signal and sends it to the main controller 10 (S210).

Based on the sensing signal generated by the paper sensor 50, the controller 10 continuously sends a control signal to drive the LF motor one step at a time. Meanwhile, the arithmetic controller 70 counts the steps of the LF motor and the count is compared to the first designated position value stored in the position value designator 60. The result of the comparison is subsequently sent to the main controller 10 (S240).

When the count value of the motor steps is equal to or greater than the first designated position value (i.e., when the paper has actually reached the first designated position), the arithmetic controller 70 sends an arrival signal to the main controller 10. As a result, the main controller 10 generates a control signal and sends it to the paper feeder 20 so as to continuously drive the LF motor one step at a time, while simultaneously sending another control signal to the printing unit 30 to move the print head 31 back and forth to level-guide the paper 100 (S240 and S310).

At that point, the lower surface of the shuttling print head 31 is equipped with a deflector guide 31*a* for pressing the transporting paper 100 down. Such force will level-guide the transporting paper 100 and permit it to eject without being jammed or folded.

The arithmetic controller 70 continuously counts the motor steps to so that they can be compared to the second designated position value. When the count value of the motor steps is equal to or greater than the second designated position value (i.e., when the paper has actually reached the second designated position), the arithmetic controller 70 sends another arrival signal to the main controller 10. Subsequently, the main controller 10 sends another control signal to stop the print head 31 while sending yet another control signal to the paper feeder 20 to continuously drive the LF motor so that the paper is transported to the eject area (S400).

Specifically, the first designated position corresponds to a point where the top of the paper passes the print head 31, and the second designated position corresponds to a point where the star-wheel 42 supports the transporting paper 100. Therefore, the print head 31 moves back and forth to level-guide the transporting paper 100 in the gap between the two positions. Such movement of the print head 31 is illustrated in FIGS. 5*a*, 5*b* and 5*c*.

Such movement of the print head 31 is totally irrelevant to the movement of the print head 31 for actual printing of data. If data needs to be printed while the print head 31 is moving, the print head 31 jets ink only when the paper 100 reaches the corresponding area of printing.

As illustrated in FIG. 6, even if rolled paper is used, the print head 31 moves back and forth to level-guide the rolled paper 100 until the guide star-wheel 41 and the star-wheel 42 guide the paper 100 to the ejecting area so as to prevent the paper 100 from being jammed or folded.

Finally, the area which the movement of the print head 31 needs to cover should be different according to the various sizes of paper that users may choose. However, selecting a paper size is generally executed through an application program in a computer and the selection is provided as an input to the printer. Therefore, the coverage area of the print head 31 is determined based on the size of the paper already determined by the computer.

To summarize, according to the present invention, when the paper 100 reaches a designated position while being transported, a print head 31 moves back and forth to level-guide the transported paper 100 with the surface of the print head 31. As a result, the paper 100 ejects without being jammed or folded, thereby preventing unwanted havoc associated with jammed or folded paper.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A paper transporting system for an ink-jet printer having a print head, said system comprising:

paper feeder means for feeding paper into said printer and for transporting said paper through said printer;

paper sensor means for sensing a presence of said paper as fed by said paper feeder means, and for generating a sensing signal;

position value designator means for storing at least one designated position value in accordance with a paper transporting distance;

arithmetic controller means responsive to said sensing signal for counting steps of said paper feeder means and for comparing a count value of said paper feeder means to said at least one designated position value; and controller means connected to said print head and responsive to said arithmetic controller means for controlling said print head to move back and forth so as to level-guide said paper with respect to a surface of said print head that faces said paper, thereby preventing said paper from becoming jammed and folded;

wherein said at least one designated position value comprises a first designated position value indicating a position at which said print head needs to move back and forth without printing to level-guide said paper.

2. The paper transporting system of claim 1, wherein said at least one designated position value further comprises a second designated position value indicating a position at which said print head stops moving to level-guide said paper.

3. The paper transporting system of claim 2, wherein said first designated position value is a count value of the steps of said paper feeder means as said paper feeder means transports said paper from said paper sensor means to a position where said print head starts to level-guide said paper.

4. The paper transporting system of claim 2, wherein said second designated position value is a count value of the steps of said paper feeder means as said paper feeder means transports said paper from said paper sensor means to an ejecting area where said paper is ejected without being jammed.

5. The paper transporting system of claim 1, wherein said first designated position value is a count value of steps of said paper feeder means as it transports said paper from said paper sensor means to a position where said print head starts to level-guide said paper.

6. The paper transporting system of claim 1, wherein said print head has a lower surface and a deflector guide disposed thereon for pressing down on the paper as said print head moves back and forth so as to level-guide said paper.

7. A paper transporting method for an ink-jet printer having a print head, said method comprising the steps of:

loading paper into an inside of the printer;

transporting said paper to a first designated position;

continuously transporting said paper past said first designated position while simultaneously moving said print head back and forth to level-guide said transported paper with respect to a surface of said print head without printing; and stopping said print head when said paper reaches a second designated position;

wherein said first designated position is a point at which said transported paper needs to be level-guided by said print head.

8. The paper transporting method of claim 7, further comprising continuously transporting said paper past said second designated position.

9. The paper transporting method of claim 8, wherein said second designated position is a point at which said transported paper is ejected without becoming jammed or folded.

10. The paper transporting method of claim 8, further comprising the step of providing a motor for transporting said paper, and wherein said second designated position is reached by said paper when said motor is driven through steps corresponding to movement of said transported paper from said first designated position to said second designated position.

11. The paper transporting method of claim 7, further comprising the step of providing a motor for transporting said paper, and wherein said first designated position is reached by said paper when said motor is driven through steps corresponding to movement of said transported paper to said first designated position.

12. The paper transporting method of claim 7, wherein said print head has a lower surface and a deflector guide disposed thereon for pressing down on the transported paper as said print head moves back and forth so as to level-guide said transported paper.

13. A paper transporting method for an ink-jet printer having a print head, said method comprising the steps of:

feeding paper into and through said printer;

sensing a presence of said paper as fed into said printer and generating a sensing signal in accordance therewith;

storing first and second designated position values in accordance with a paper transporting distance;

counting steps as said paper is fed through said printer;

comparing a count value from said counting step to said first and second designated position values; and controlling said print head, in accordance with a result of said comparing step, to move back and forth so as to level-guide said paper without printing with respect to a surface of said print head that faces said paper, thereby preventing said paper from becoming jammed and folded.

14. The paper transporting method of claim 13, wherein said first designated position value indicates a position at which said print head starts to move back and forth to level-guide said paper.

15. The paper transporting system of claim 13, wherein said second designated position value indicates a position at which said print head stops moving back and forth to level-guide said paper.

16. The paper transporting method of claim 13, wherein said print head has a lower surface and a deflector guide disposed thereon for pressing down on the paper as said print head moves back and forth so as to level-guide said paper.

* * * * *